US009284155B2

(12) United States Patent
Stanton

(10) Patent No.: US 9,284,155 B2
(45) Date of Patent: Mar. 15, 2016

(54) COLLAPSIBLE CORD HOLDER

(71) Applicant: Martin Patrick Stanton, Trinity, FL (US)

(72) Inventor: Martin Patrick Stanton, Trinity, FL (US)

( * ) Notice: Subject to any disclaimer, the term of this patent is extended or adjusted under 35 U.S.C. 154(b) by 332 days.

(21) Appl. No.: 13/936,976

(22) Filed: Jul. 8, 2013

(65) Prior Publication Data

US 2014/0014763 A1 Jan. 16, 2014

Related U.S. Application Data

(60) Provisional application No. 61/670,313, filed on Jul. 11, 2012.

(51) Int. Cl.
*B65H 49/30* (2006.01)
*B65H 75/24* (2006.01)

(52) U.S. Cl.
CPC ..... *B65H 49/30* (2013.01); *B65H 75/242* (2013.01)

(58) Field of Classification Search
CPC ..... B65H 75/22; B65H 75/24; B65H 75/242; B65H 75/241; B65H 49/30
USPC ..... 242/571, 577, 577.2, 607.1, 127, 129, 242/401, 405, 405.1, 405.2, 405.3
See application file for complete search history.

(56) References Cited

U.S. PATENT DOCUMENTS

| | | | | | |
|---|---|---|---|---|---|
| 325,394 | A * | 9/1885 | Cavalli | B65H 49/30 | 242/129 |
| 2,057,728 | A * | 10/1936 | Lester | B65H 49/30 | 242/127 |
| 2,141,579 | A * | 12/1938 | White | A01K 97/16 | 242/404.2 |
| 2,555,851 | A * | 6/1951 | Hancock | A01K 97/16 | 242/577.2 |
| 3,215,364 | A * | 11/1965 | George | B65H 49/30 | 242/127 |
| 4,192,473 | A * | 3/1980 | Wellman | B65H 49/30 | 242/127 |
| 7,395,985 | B2 * | 7/2008 | Lazarro | B63B 21/04 | 242/401 |

* cited by examiner

*Primary Examiner* — Sang Kim
*Assistant Examiner* — Nathaniel Adams

(57) ABSTRACT

A collapsible cord holder is an apparatus that is specifically designed to prevent entanglements when unwinding an existing cord bundle. The collapsible cord holder accomplishes this through the use of an extendable arm assembly that is pivotally coupled to a handle assembly and secured in both an expanded configuration and a collapsed configuration through a locking mechanism. The arm assembly is able to arcuately expand beyond the diameter of the cord bundle in order to apply tension facilitating the unwinding of the cord bundle. The handle assembly permits an axial rotation of the cord bundle mounted on the collapsible cord holder in order to facilitate unwinding and prevent entanglements. The locking mechanism provides a secure engagement in the expanded configuration allowing the apparatus to transition into the collapsed configuration.

6 Claims, 14 Drawing Sheets

COLLAPSIBLE CORD HOLDER

The current application claims a priority to the U.S. Provisional Patent application Ser. No. 61/670,313 filed on Jul. 11, 2012.

FIELD OF THE INVENTION

The present invention relates generally to a cord holder, more particularly to a collapsible cord holder specifically designed for unwinding cord bundles created by user's wrapping long lengths of cord around their forearm.

BACKGROUND OF THE INVENTION

It is well known that a plurality of devices utilize long lengths of cord in order to extend their function. These devices may utilize the long lengths of cord as a means of receiving power but could also use the long lengths of cord as a mean of extending the reach of communicating with other devices through a plurality of means. Although the specific use of the long lengths of cord vary between the plurality of devices, the long lengths of cord are almost always wrapped in a cord bundle in order to conserve storage space. Typically, after a user is finished using a device, they would spool the long length of cord into a cord bundle by wrapping the long length of cord around the length of their forearm. The user would then remove their arm from the center of the cord bundle and place the cord for storage. While these cord bundles are a convenient means of organizing and storing long lengths of cord, the lack of a physical spool retaining the shape of the cord bundle makes them prone to entanglements upon unwinding.

Although the issue of entanglements upon unwinding a cord bundle is well known, adequate solutions for preventing entanglements are not readily available. The majority of the prior art describes apparatuses that prevent entanglements, but require the long length of cord to be initially spooled and stored on a particular apparatus or device in order to function properly. This pre-requisite hinders the functionality of the existing prior art and fails to provide an adequate solution for preventing entanglements upon unwinding an existing cord bundle.

It is therefore the object of the present invention to provide a collapsible cord holder is an apparatus that is specifically designed to prevent entanglements when unwinding an existing cord bundle. The collapsible cord holder accomplishes this through the use of an extendable arm assembly that is pivotally coupled to a handle assembly and secured in both an expanded configuration and a collapsed configuration through a locking mechanism. The arm assembly is able to arcuately expand beyond the diameter of the cord bundle in order to apply tension facilitating the unwinding of the cord bundle. The handle assembly permits an axial rotation of the cord bundle mounted on the collapsible cord holder in order to facilitate unwinding and prevent entanglements. The locking mechanism provides a secure engagement in the expanded configuration allowing the apparatus to transition into the collapsed configuration in order to allow for facilitated insertion into existing cord bundles, additionally the collapsed configuration provides a means of facilitated storage when not in use.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
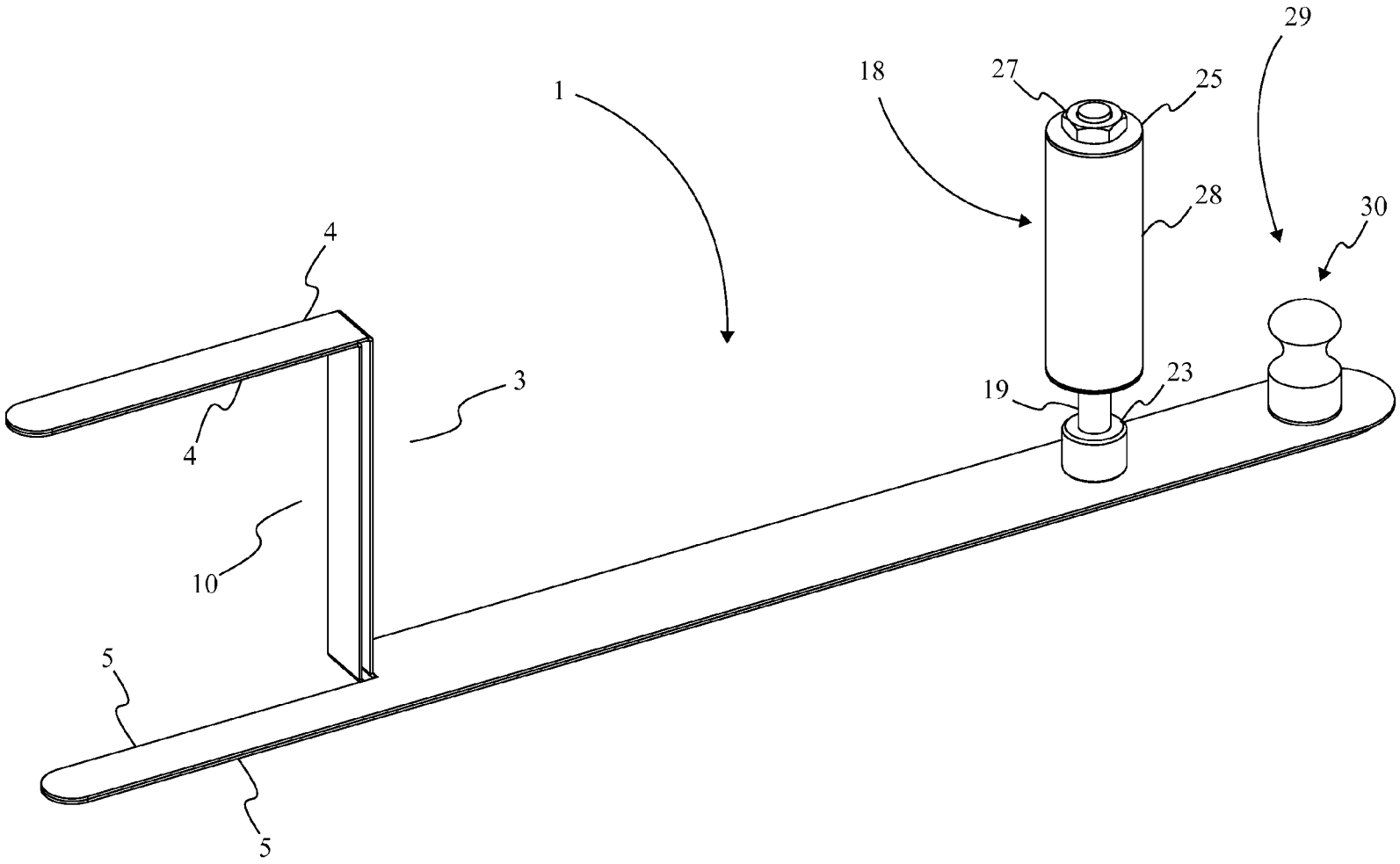
FIG. 1 is a perspective view displaying the collapsible cord holder, utilizing the compression plunger assembly as the locking mechanism, in the collapsed configuration as per the current embodiment of the present invention.
Figure 6:
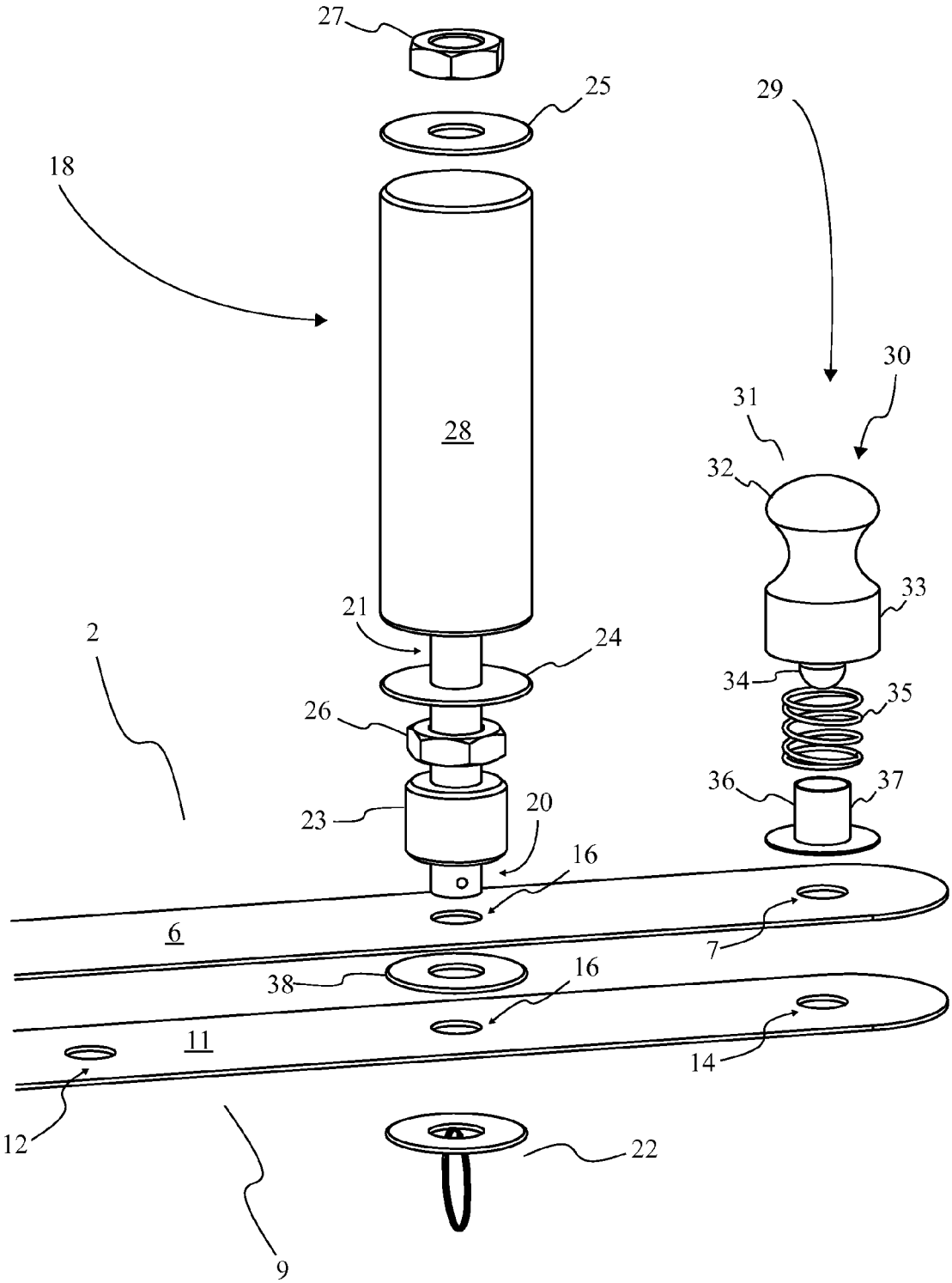
FIG. 6 is an expanded view displaying the internal component distribution of the collapsible cord holder as per the current embodiment of the present invention.
Figure 7:
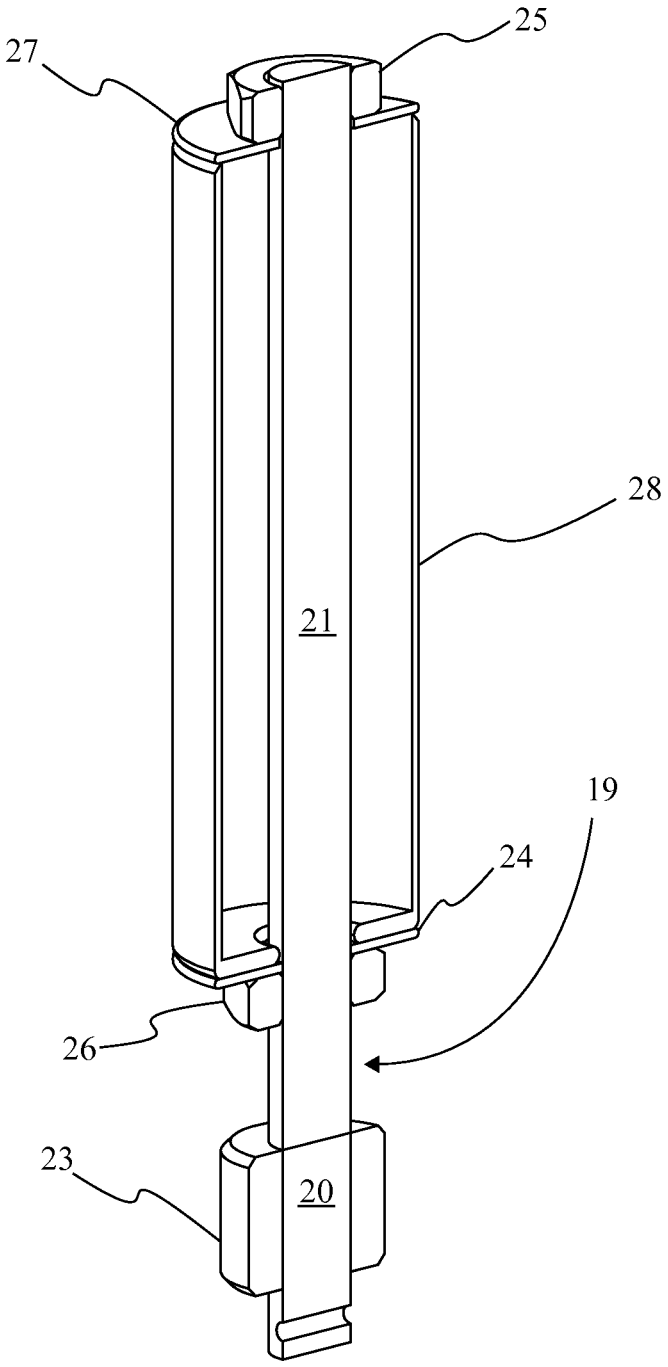
FIG. 7 is an enhanced cross sectional view displaying the internal component distribution of the handle assembly as per the current embodiment of the present invention.
Figure 8:
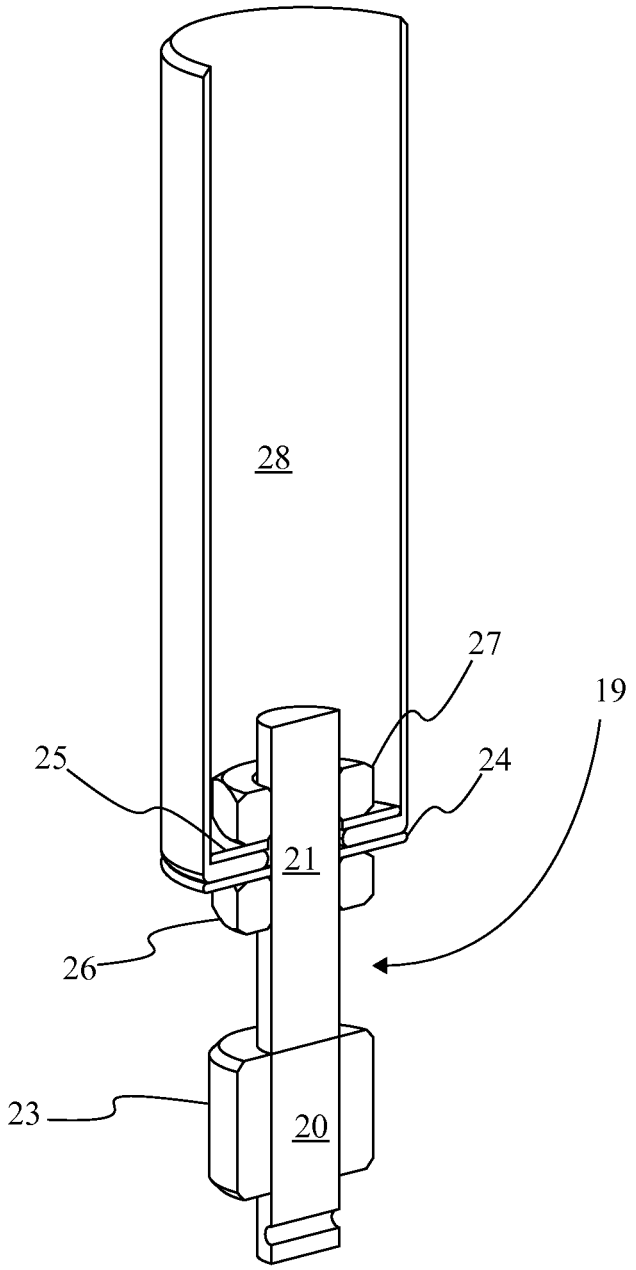
FIG. 8 is an enhanced cross sectional view displaying the internal component distribution of the handle assembly as per an additional embodiment of the present invention.

Referencing FIG. 1 and FIG. 6, the present invention is a collapsible cord holder that is specifically designed for unwinding cord bundles. In the current embodiment of the present invention, the collapsible cord holder comprises an extendable arm assembly 1, a handle assembly 18, and locking mechanism 29. The extendable arm assembly 1 is provided as the engaging component of the present invention that provides support and tension to the cord bundle. The handle assembly 18 is provided as an axle and a pivot point for the extendable arm assembly 1. The locking mechanism 29 is provided as the means of securing the extendable arm assembly 1 in a collapsed configuration and an extended configuration. The extendable arm assembly 1 is found centrally engaged to the handle assembly 18 by way of a handle assembly mount 16 associated with the extendable arm assembly 1. The extendable arm assembly 1 is found rotatably coupled to the handle assembly 18, wherein the rotatable coupling permits the handle assembly 18 to function as an axle and pivot point for the extendable arm assembly 1. The extendable arm assembly 1 is found bi-stately secured by way of the locking mechanism 29, wherein the locking mechanism 29 permits the extendable arm assembly 1 to be configured in the extended configuration and the collapsed configuration. The locking mechanism 29 is found positioned adjacent to the handle assembly 18, wherein the locking mechanism 29 and the handle assembly 18 are found adjacently positioned relative to their engagement with the extendable arm assembly 1.

Referencing FIG. 1-3 and FIG. 6, the extendable arm assembly 1, in the current embodiment of the present invention, comprises a first arm 2, a second arm 9, and a handle assembly mount 16. The first arm 2 and the second arm 9 are functionally equivalent component bodies that rotatably engage a cord bundle in order to provide structural support to said cord bundle when unwinding. The handle assembly mount 16 is provided as a shared engagement point between the first arm 2 and the second arm 9. The first arm 2 and the second arm 9 are found rotatably coupled to the handle assembly mount 16. the handle assembly 18 is found traversing the first arm 2 and the second arm 9 by way of the handle assembly mount 16, wherein the positioning of the handle assembly mount 16 allows the handle assembly 18 to function as a centrally positioned axle shaft in the extended configuration, and a pivot point between the first arm 2 and the second arm 9 in the transition state between the collapsed configuration and the extended configuration.

Figure 2:
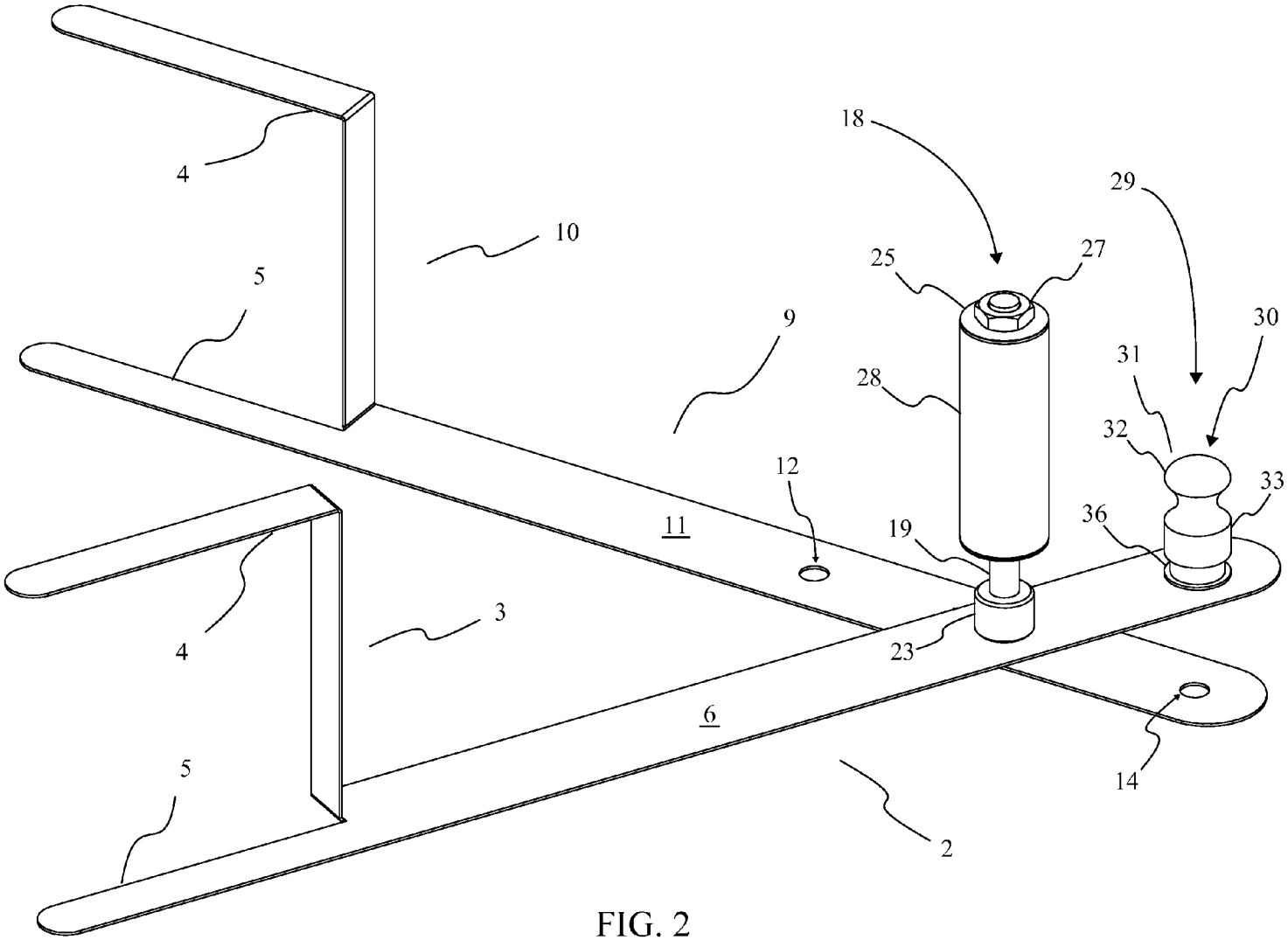
FIG. 2 is a perspective view displaying the collapsible cord holder, utilizing the compression plunger assembly as the locking mechanism, transitioning between the collapsed configuration and the extended configuration as per the current embodiment of the present invention.
Figure 3:
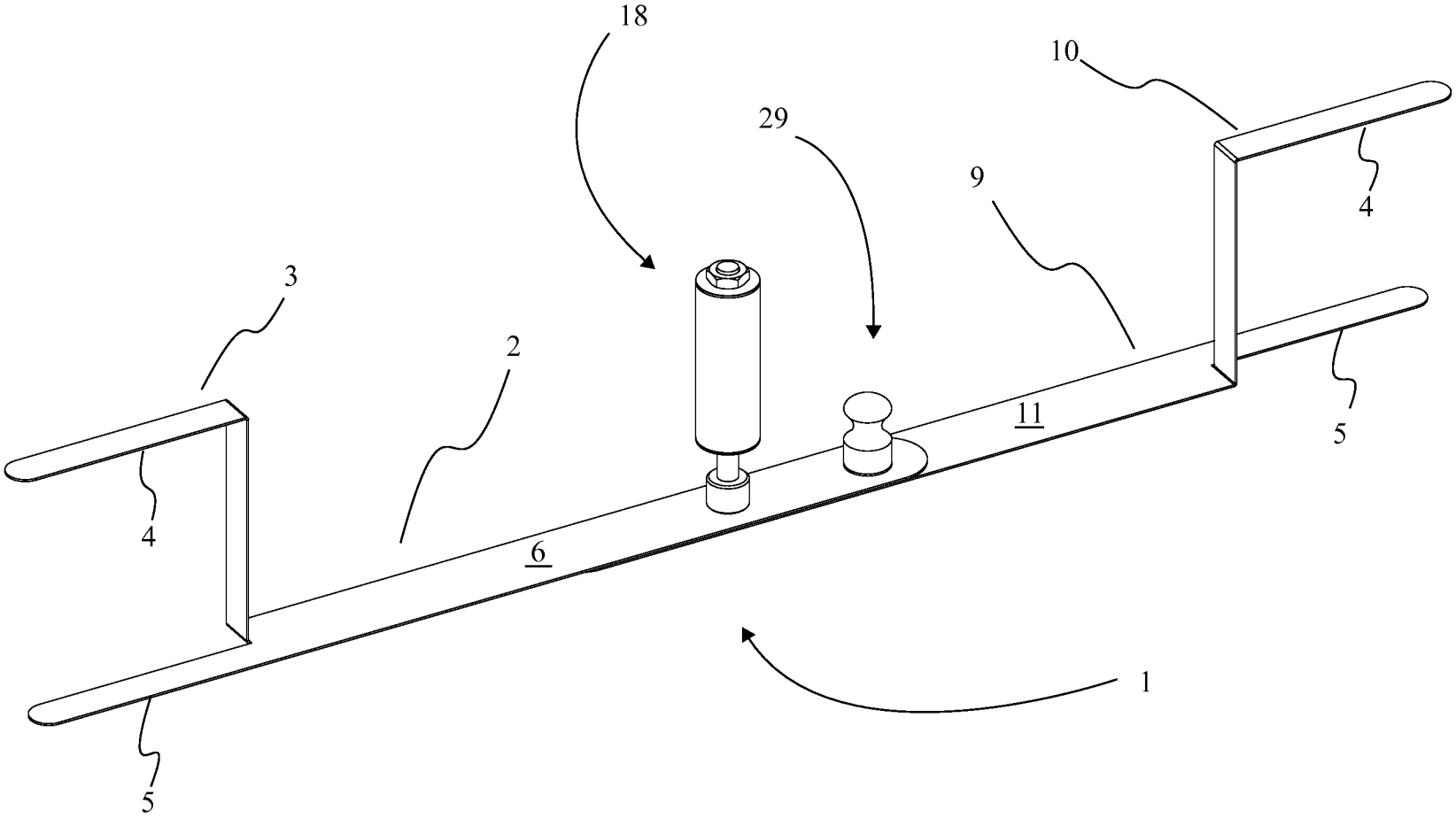
FIG. 3 is a perspective view displaying the collapsible cord holder, utilizing the compression plunger assembly as the locking mechanism, in the extended configuration as per the current embodiment of the present invention.

Referencing FIG. 2 and FIG. 6, the first arm 2 and the second arm 9, in the current embodiment of the present invention, are provided as functionally equivalent component where the first arm 2 comprises a first retainer mount 3 and a first longitudinal body 6, while the second arm 9 comprises a second retainer mount 10 and a second longitudinal body 11. The first retainer mount 3 and the second retainer mount 10 are functionally similar and serve as engagement points with the cord bundle. The first longitudinal body 6 and the second longitudinal body 11 are functionally similar and serve as the rotatably coincident structures of the first arm 2 and the second arm 9, respectively, that extend the reach of the first retainer mount 3 and the second retainer mount 10 from the handle assembly mount 16. In the current embodiment of the present invention, the first longitudinal body 6 comprises a first lock mount 7, while the second longitudinal body 11 comprises a second open lock mount 12 and a second closed lock mount 14. The first lock mount 7 is provided as the engagement point that joins the locking mechanism 29 with the first arm 2. the second closed lock mount 14 and the second open lock mount 12 are provided as the engagement points between the locking mechanism 29 and the second arm 9, wherein the locking mechanism 29 is coincident with the second open lock mount 12 in the extended configuration and the second closed lock mount 14 in the collapsed configuration. both the second open lock mount 12 and the second closed lock mount 14 are found rotatably coincident with the first lock mount 7, wherein the first lock mount 7 is coincident with the second open lock mount 12 in the extended configuration and coincident with the second closed lock mount 14 in the collapsed configuration.

Referencing FIG. 1-3 and FIG. 6, the handle assembly mount 16 is found positioned between the first lock mount 7 and the first retainer mount 3, wherein the handle assembly mount 16 is found traversing through the first longitudinal body 6 between the first lock mount 7 and the first retainer mount 3. the handle assembly mount 16 is found positioned between the second open lock mount 12 and the second closed lock mount 14, wherein the handle assembly mount 16 is found traversing through the second longitudinal body 11 between the second open lock mount 12 and the second closed lock mount 14. The first retainer mount 3 is found terminally coupled to the first longitudinal body 6 opposite the positioning of the first lock mount 7. The second retainer mount 10 is found terminally coupled to the second longitudinal body 11 opposite the second closed lock mount 14. the first retainer mount 3 and the second retainer mount 10 being positioned equidistantly to the handle assembly mount 16, wherein the distance from the handle assembly mount 16 along the first longitudinal body 6 to the first retainer mount 3 and the distance between the handle assembly mount 16 along the second longitudinal body 11 to the second retainer mount 10 are congruent in the extended configuration. It should be noted that the equidistant positioning of the handle assembly mount 16 to both the first retainer mount 3 and the second retainer mount 10 is a relative measurement and would be dependent on the bi-stately configuration of the extendable arm assembly 1.

Figure 4:
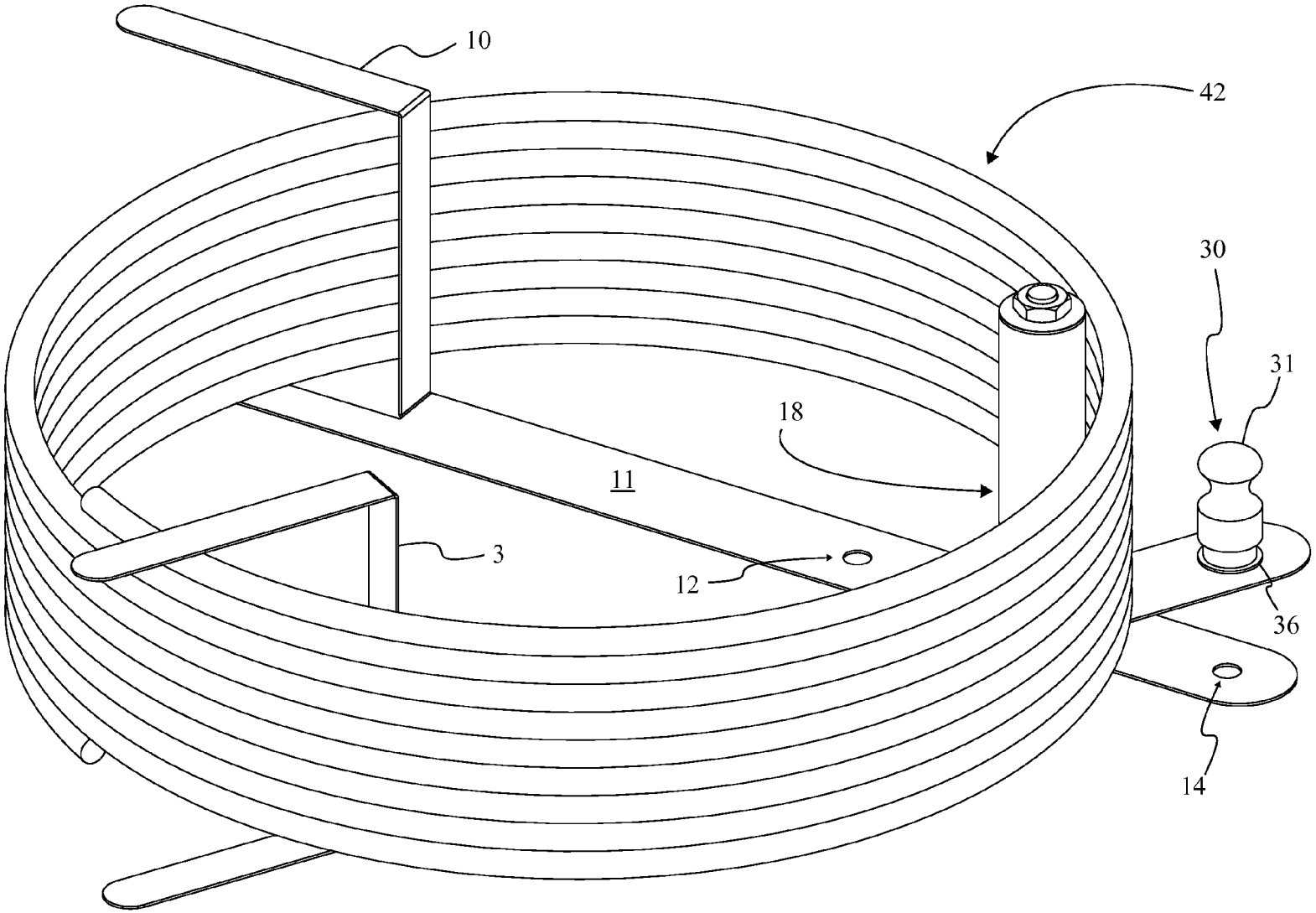
FIG. 4 is a perspective view displaying the collapsible cord holder engaged with a cord bundle while transitioning between the collapsed configuration and the extended configuration as per the current embodiment of the present invention.
Figure 5:
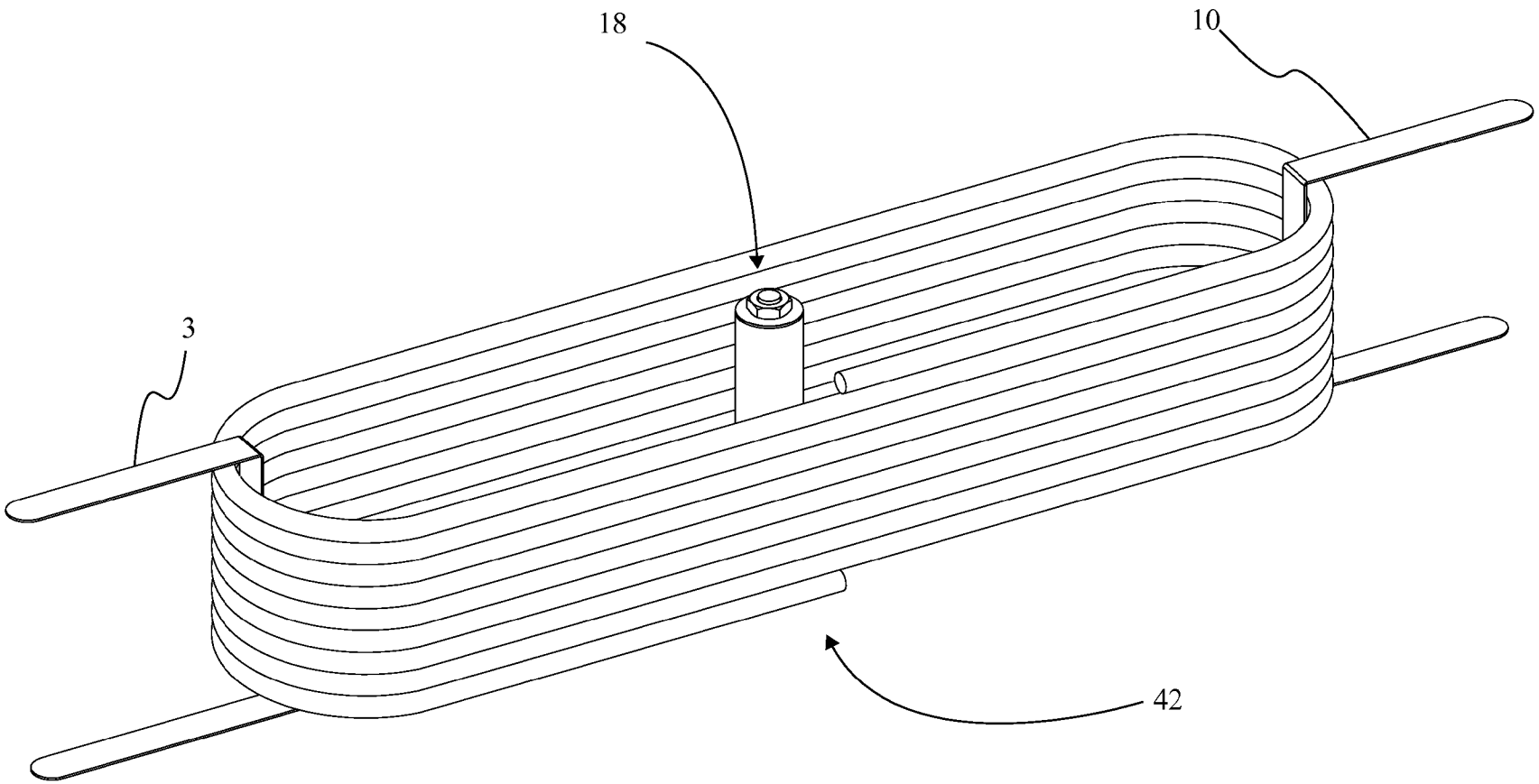
FIG. 5 is a perspective view displaying the collapsible cord holder engaged with a cord bundle in the extended configuration as per the current embodiment of the present invention.

Referencing FIG. 4-6, both the first retainer mount 3 and the second retainer mount 10 each comprise an elongated member 5 and an angled member 4. The elongated member 5 and the angled member 4 are provided as complementary components that form a C-shaped cord retaining structure that engages the interior portion of the cord bundle 43. The elongated member 5 of the first retainer mount 3 is found engaged collinearly with the first longitudinal body 6, wherein the elongated member 5 of the first retainer mount 3 extends from the first longitudinal body 6 maintaining a linear path to the first longitudinal body 6. The elongated member 5 of the second retainer mount 10 is found engaged collinearly with the second longitudinal body 11, wherein the elongated member 5 of the second retainer mount 10 extends from the second longitudinal body 11 maintaining a linear path to the second longitudinal body 11. The angled member 4 of the first retainer mount 3 is found positioned perpendicularly to the first longitudinal body 6, wherein the perpendicular positioning is shared with the elongated member 5 of the first retainer mount 3. The angled member 4 of the second retainer mount 10 is found positioned perpendicularly to the second longitudinal body 11, wherein the perpendicular positioning is shared with the elongated member 5 of the second retainer mount 10. In the preferred embodiment of the present invention, the angled member 4 is found positioned adjacent to the elongated member 5, wherein the angled member 4 is positioned non-coplanar with the elongated member 5. The angled member 4 is provided with an offset positioning to the elongated member 5, wherein the offset enables the angled member 4 to be parallel to the planar positioning of the elongated member 5. In the collapsed configuration the first arm 2 would stack on top of the second arm 9, wherein the components of the first arm 2 would rest coincident with the equivalent components of the second arm 9. The first arm 2 is provided as being slightly larger than the second arm 9 enabling first arm 2 to rest coincident with the second arm 9 but allowing rotation about the handle assembly mount 16.

Referencing FIG. 6-9, the handle assembly 18 is provided as a pivot point and as a centrally positioned axle shaft for the extendable arm assembly 1. In the current embodiment of the present invention, the handle assembly 18 comprises a rod 19, a key ring fastener 22, a bearing plate 38, a bottom spacer 23, a first disc bearing 24, a second disc bearing 25, a first disc fastener 26, a second disc fastener 27, and a shaft handle 28. the rod 19 is a cylindrical body that is centrally positioned to the key ring fastener 22, the bearing plate 38, the bottom spacer 23, the first disc bearing 24, the second disc bearing 25, the first disc fastener 26, the second disc fastener 27, and the shaft handle 28. The rod 19 comprises a first rod end 20 and a second rod end 21. The first rod end 20 is found coincident with the extendable arm assembly 1, while the second rod end 21 is positioned away from the extendable arm assembly 1. The bearing plate 38 is provided as a low friction surface that is rotatably engaged to the first longitudinal body 6 and the second longitudinal body 11. The key ring fastener 22 and the bottom spacer 23 function as the engagements that rotatably secure the extendable arm assembly 1 about the handle assembly mount 16. The key ring fastener 22 is additionally provided as a means of securing a terminal end of an existing cord bundle 43. Furthermore, the key ring fastener 22 functions as tool-less means of detaching the handle assembly 18 from the extendable arm assembly 1. The first disc bearing 24 and the second disc bearing 25 functions as bearing surfaces which interact with the shaft handle 28 permitting rotation. The first disc fastener 26 and the second disc fastener 27 are provided as the means of securing the first disc bearing 24 and the second disc bearing 25, respectively to the shaft handle 28. The shaft handle 28 is a hollow cylindrical component that rotates about the second rod end 21. In the preferred embodiment of the present invention, the key ring fastener 22 utilizes a washer plate that is positioned between the key ring fastener 22 and the second longitudinal body 11. The washer plate improves the interaction between the key ring fastener and the second longitudinal body 11 by reducing friction and providing a reinforced contact point for the key ring fastener 22.

Referencing FIG. 1-3 and FIG. 6, the extendable arm assembly 1 is rotatable about the rod 19, specifically, the extendable arm assembly 1 is rotatable about the first rod end 20 between the key ring fastener 22 and the bottom spacer 23. The handle assembly 18 is secured to the extendable arm assembly 1 by way of the key ring fastener 22. The key ring fastener 22 is found rotatably coincident with the second arm 9, while the bottom spacer 23 is found rotatably coincident with the first arm 2. The bearing plate 38 being positioned between the first arm 2 and the second arm 9. The bearing plate 38 is found rotatably engaged with the first longitudinal body 6 and the second longitudinal body 11. The bottom spacer 23 function as a separator between the first rod end 20 and the second rod end 21. The shaft handle 28 is found rotatable about the second rod end 21. The shaft handle 28 is found rotatably engaged to the first disc bearing 24 and the second disc bearing 25. The first disc bearing 24 is retained against shaft handle 28 by way of the first disc fastener 26 while the second disc bearing 25 is retained against the shaft handle 28 by way of the second disc fastener 27. It should be noted that bottom spacer 23, the first disc bearing 24, and the second disc bearing 25 can be constructed of a self lubricating materials in order to reduce the amount of friction experienced upon rotation. Furthermore, while the shaft handle 28 is described as being rotatably engaged between the first disc bearing 24 and the second disc bearing 25, the positioning of the first disc bearing 24 and the second disc bearing 25 relative to the shaft handle 28 is not explicitly described. Referencing FIG. 7 and FIG. 8 it should be noted that the positioning of the first disc bearing 24 and the second disc bearing 25 relative to the shaft handle 28 could be provided in a manner that encloses the hollow cavity of the shaft handle 28 or permits it to remain open.

Referencing FIG. 1-3 and FIG. 6, the extended configuration is provided as an activated state for the extendable arm assembly 1, wherein the extendable arm assembly 1 is engaged or engaging a cord bundle 43 in order to facilitate unwinding of said cord bundle 43. In the extended configuration, the first retainer mount 3 is positioned furthest from the second retainer mount 10. The first longitudinal body 6 and the second longitudinal body 11 are provided with a parallel arrangement that permits the coincident engagement of the first lock mount 7 with the second open lock mount 12. The collapsed configuration is provided as a neutral state for the extendable arm assembly 1, wherein the extendable arm assembly 1 is collapsed allowing positioning of with an existing cord bundle 43, as well as providing a means of facilitated storage when not in use. In the collapsed configuration, the first retainer mount 3 and the second retainer mount 10 are found adjacently positioned, wherein the distance between the first retainer mount 3 and the second retainer mount 10 is at its shortest. The first longitudinal body 6 and the second longitudinal body 11 are provided with a parallel arrangement that permits the coincident engagement of the first lock mount 7 with the second closed lock mount 14. The extendable arm assembly 1 is provided with a pivotable engagement with the handle assembly 18 about the handle assembly mount 16. The pivotable engagement permits the transition of the extendable arm assembly 1 from the collapsed configuration to the extended configuration.

Figure 9:
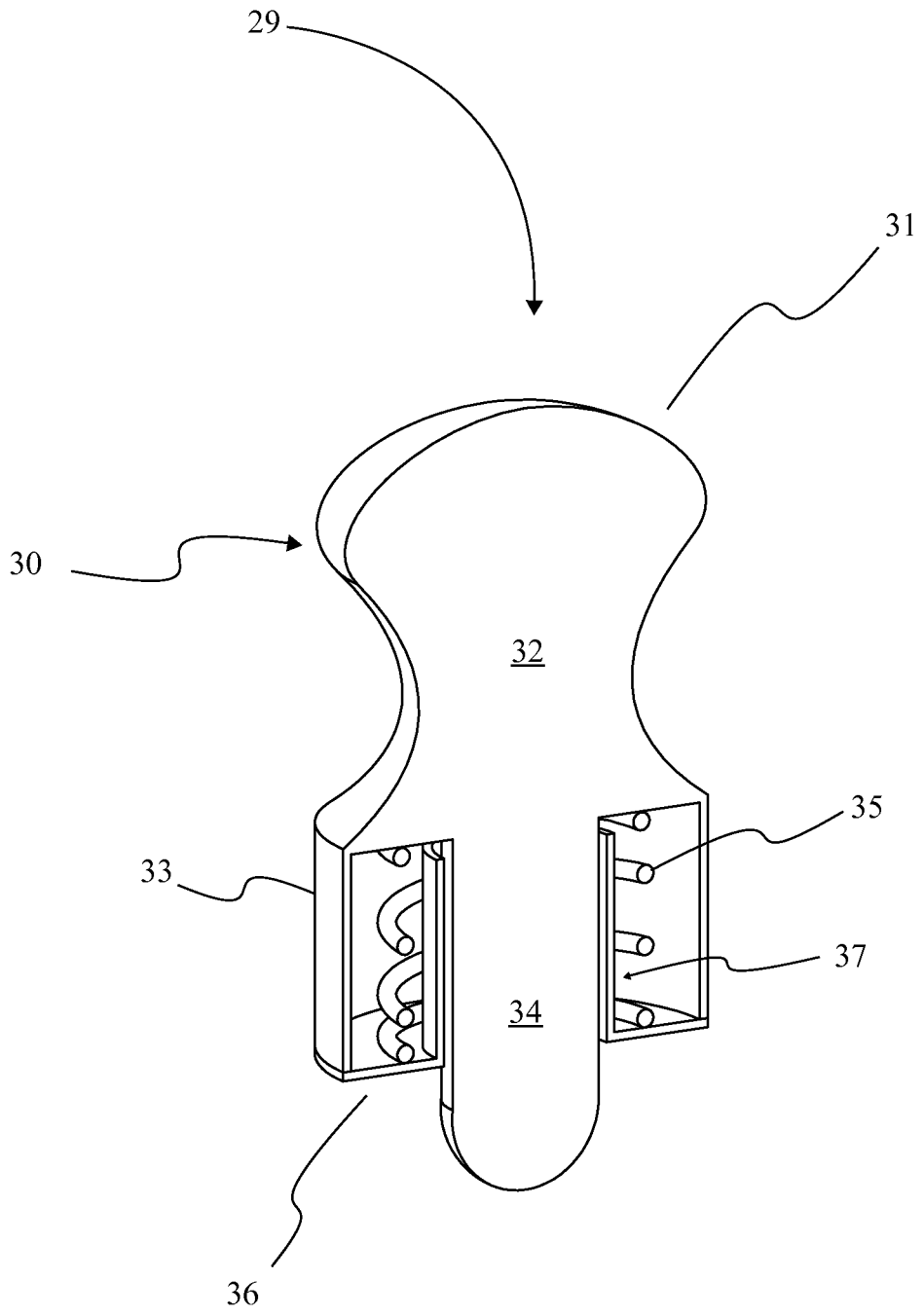
FIG. 9 is an enhanced cross sectional view displaying the internal component distribution of the compression plunger assembly as per the current embodiment of the present invention.

Referencing FIG. 6 and FIG. 9, the locking mechanism 29, in the current embodiment of the present invention is provided as a means of securing the extendable arm assembly 1 in the extended configuration and the collapsed configuration. The locking mechanism 29 is provided with an adjacent positioning with the handle assembly 18 due to the alignment of the locking mechanism 29 with the first lock mount 7, the second open lock mount 12, and the second closed lock mount 14. In the preferred embodiment of the present invention, the locking mechanism 29 comprises a compression plunger assembly 30. The compression plunger assembly 30 is a disengageable means of securing the extendable arm assembly 1 in either the extended configuration or the collapsed configuration. The compression plunger assembly 30 comprises a plunger assembly 31 and a base mount 36. The base mount 36 is concentrically positioned with the first lock mount 7, wherein the base mount 36 is centrally aligned with the first lock mount 7. The central alignment provides the plunger assembly 31 with a coincident alignment with the first lock mount 7 permitting a detachable engagement with the second open lock mount 12 and the second closed lock mount 14.

Referencing FIG. 6 and FIG. 9, in the preferred embodiment of the present invention, the plunger assembly 31 comprises a plunger handle 32, an assembly shroud 33, a piston 34, and a spring. The plunger handle 32 is provided as a human engageable structure that additionally functions as a mounting point for the assembly shroud 33, the piston 34 and the spring 35. The piston 34 is the component that detachably engages the first arm 2 and the second arm 9. The assembly shroud 33 is provided as a means of stabilizing and reducing unwanted lateral movement in the spring 35 during use. The spring 35 is provided as the elastic component that retains the piston 34 to the base mount 36. The base mount 36 is provided as a structural element that securely mounts the compression plunger assembly 30 to the first longitudinal body 11. In the preferred embodiment of the present invention the base mount 36 comprises a piston shaft 37. The piston shaft 37 is provided as a cylindrical sleeve which aligns the piston 34 with the first lock mount 7 and the second longitudinal body 11 during use. The piston shaft 37 is centrally aligned with the first lock mount 7, wherein the piston shaft 37 and the first lock mount 7 form a traversable channel for the piston 34. The piston shaft 37 prevents lateral movement of the piston 34 as it traverses through the first lock mount 7 and detachably engages the second longitudinal body 11. The plunger assembly 31 is elastically retained to the base mount 36 by way of the spring 35. The spring 35, the piston 34, and the assembly shroud 33 are found positioned concentrically on the plunger handle 32. The piston 34 traverse through the piston shaft 37. The piston shaft 37 is found positioned between the spring 35 and the piston 34. The spring 35 is found positioned between the piston shaft 37 and the assembly shroud 33. Through the aforementioned positioning the piston 34 is able to traverse the first lock mount 7 and the second longitudinal body 11, wherein the piston 34 traverse the second open lock mount 12 during the extended configuration, while the piston 34 traverse the second closed lock mount 14 during the collapsed configuration.

Referencing FIG. 4-FIG. 6, in the preferred embodiment of the present invention, the user would position the collapsed configuration of the present invention within the circular opening of a cord bundle 43. The user would engage the first retainer mount 3 and the second retainer mount 10 with the cord bundle 43. After which the user would proceed to disengage the piston 34 with the second closed lock mount 14. The user would pull the plunger handle 32 away from the base mount 36 retracting the piston 34 within the piston shaft 37, disengaging the piston 34 from the second closed lock mount 14. The user would permit the spring 35, and subsequently the piston 34, to return to their un-retracted resting state. The user would pivot the second arm 9 about the handle assembly mount 16. Upon pivoting the second arm 9, the first retainer mount 3 and the second retainer mount 10 would traverse along the interior of the cord bundle 43 tightening and providing shape to said cord bundle 43. Pivoting would continue until the first arm 2 and the second arm 9 became collinear. Upon which point, the piston 34 would rotatably interact with the lateral portion of the second longitudinal body 11, resulting in the piston 34 being retracted into the piston shaft 37 and causing the compression of the spring 35. The piston 34 would remains retracted until the first lock mount 7 becomes coincident with the second open lock mount 12. At which point, the piston 34 would traverse into the second open lock mount 7 due to the spring 35 returning to it's resting state. The piston 34 would engage the second open lock mount 7 securing the extendable arm assembly 1 in the expanded configuration. The user would be able to unwind the cord bundle 43 by grasping the handle assembly 18, wherein the handle assembly 18 would permit rotation of the extendable arm assembly 1 as needed.

Referencing FIG. 10-13, in an additional embodiment of the present invention, the locking mechanism 29 comprises a retainer clip 39. The retainer clip 39 is a flexible component holds the first lock mount 7 in alignment with either the second closed lock mount 14 or the second open lock mount 12 depending on the configuration state. In the current embodiment of the present invention, the retainer clip 39 comprises a first rounded clasp 40, a second rounded clasp 41 and a flexible member 42. The first rounded clasp 40 and the second rounded clasp 41 are functionally similar components that are retained against one another by way of the flexible member 42. The flexible member 42 is the portion of the retainer clip 39 that secures the first rounded clasp 40 and the second rounded clasp 41 in place. the retainer clip 39 is rotatably coupled to the extendable arm assembly 1, wherein the rotatably coupling allows the retainer clip 39 to remain engaged with the first lock mount 7 while allowing the second arm 9 to pivots about the handle assembly mount 16 without obstruction. The first rounded clasp 40 is elastically retained against the second rounded clasp 41 by way of the flexible member 42. The first rounded clasp 40 is coincident with the first lock mount 7. the second open lock mount 12 and the second closed lock mount 14 are bi-stately coincident with the second rounded clasp 41, wherein the second closed lock mount 14 is coincident with the second rounded clasp 41 in the collapsed configuration while the second open lock mount 12 is coincident with the second rounded clasp 41 in the extended configuration.

Figure 10:
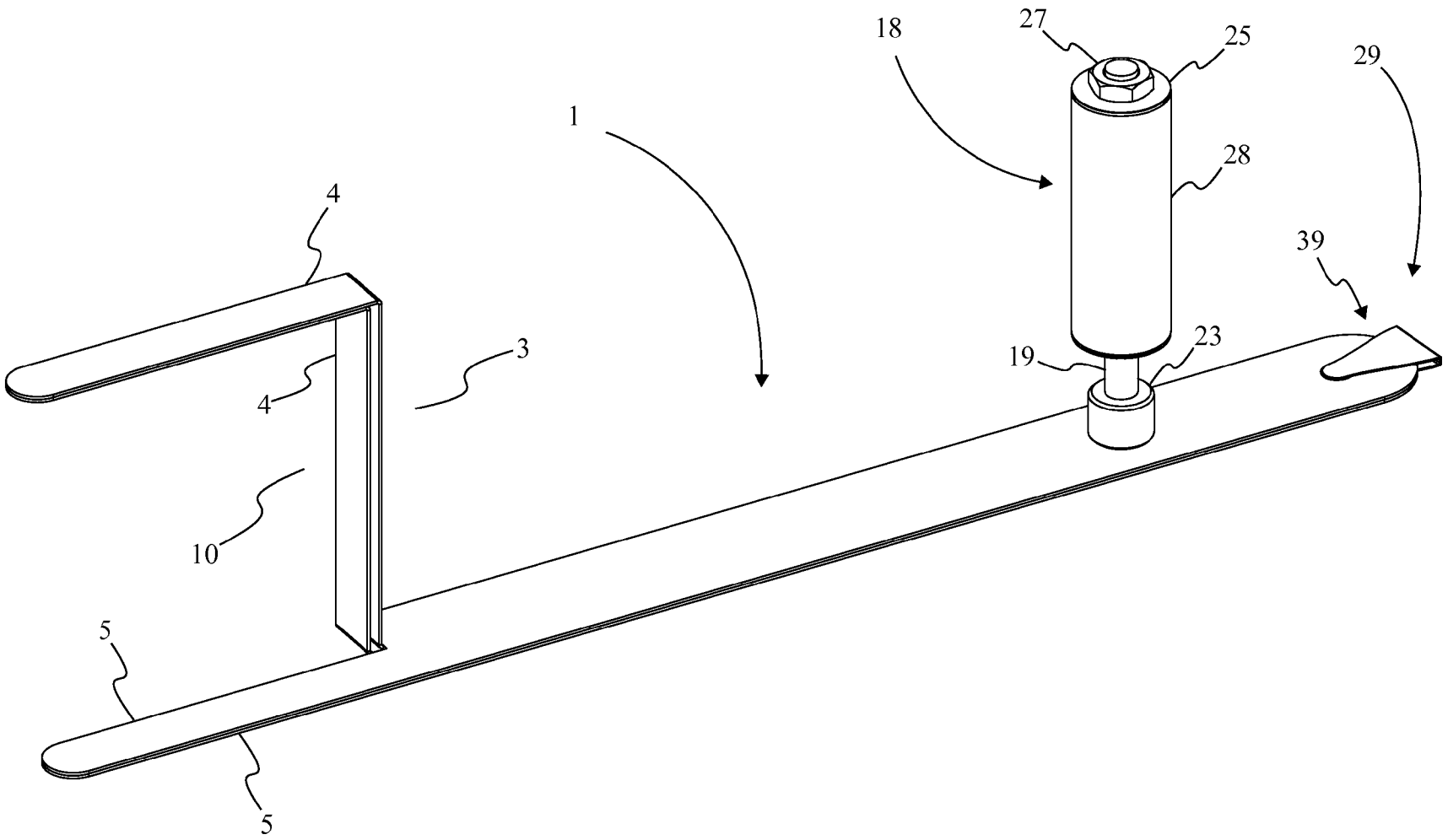
FIG. 10 is a perspective view displaying the collapsible cord holder, utilizing the retainer clip as the locking mechanism, in the collapsed configuration as per the additional embodiment of the present invention.
Figure 11:
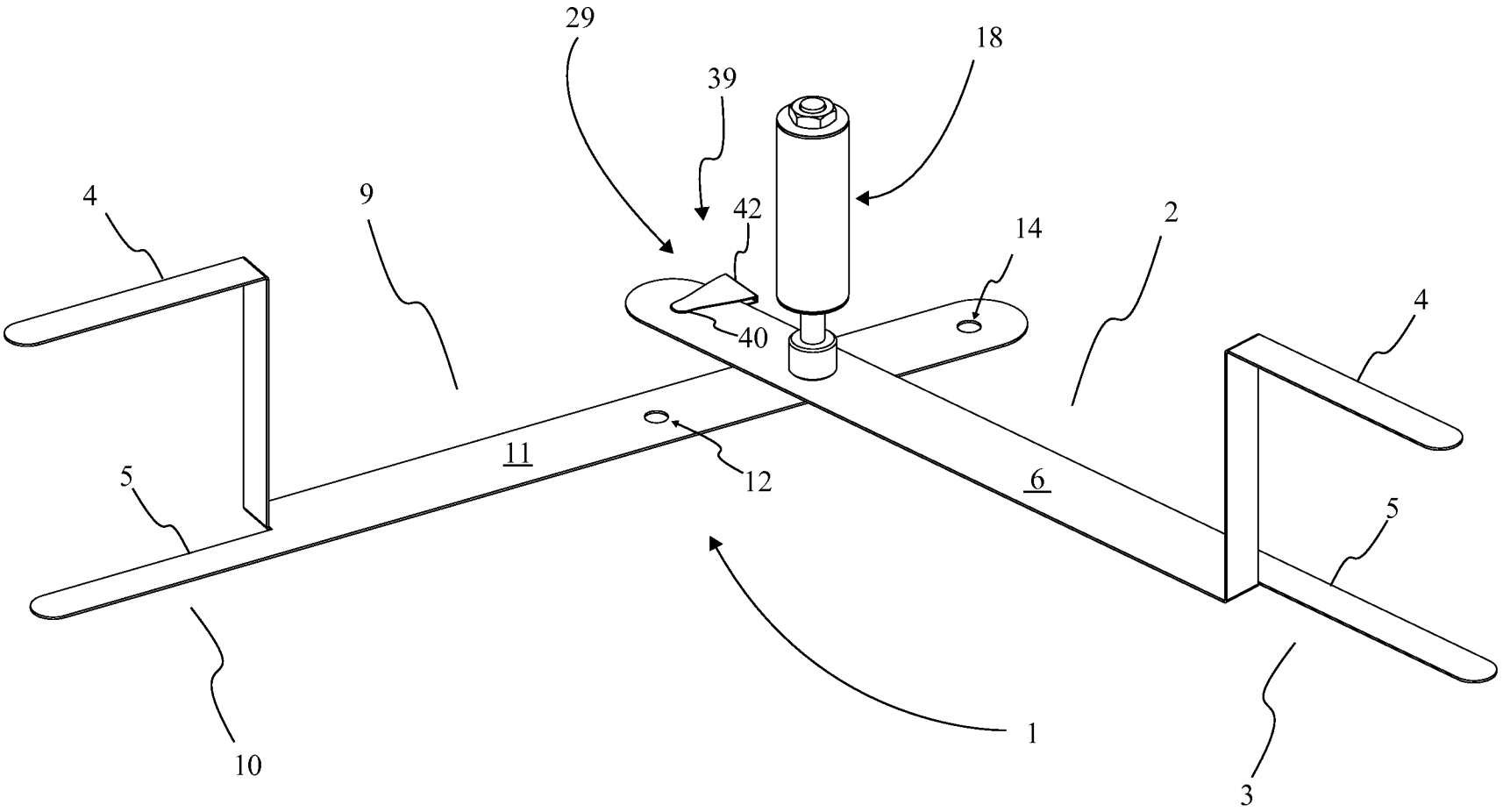
FIG. 11 is a perspective view displaying the collapsible cord holder utilizing the retainer clip as the locking mechanism transitioning between the collapsed configuration and the extended configuration as per the additional embodiment of the present invention.
Figure 12:
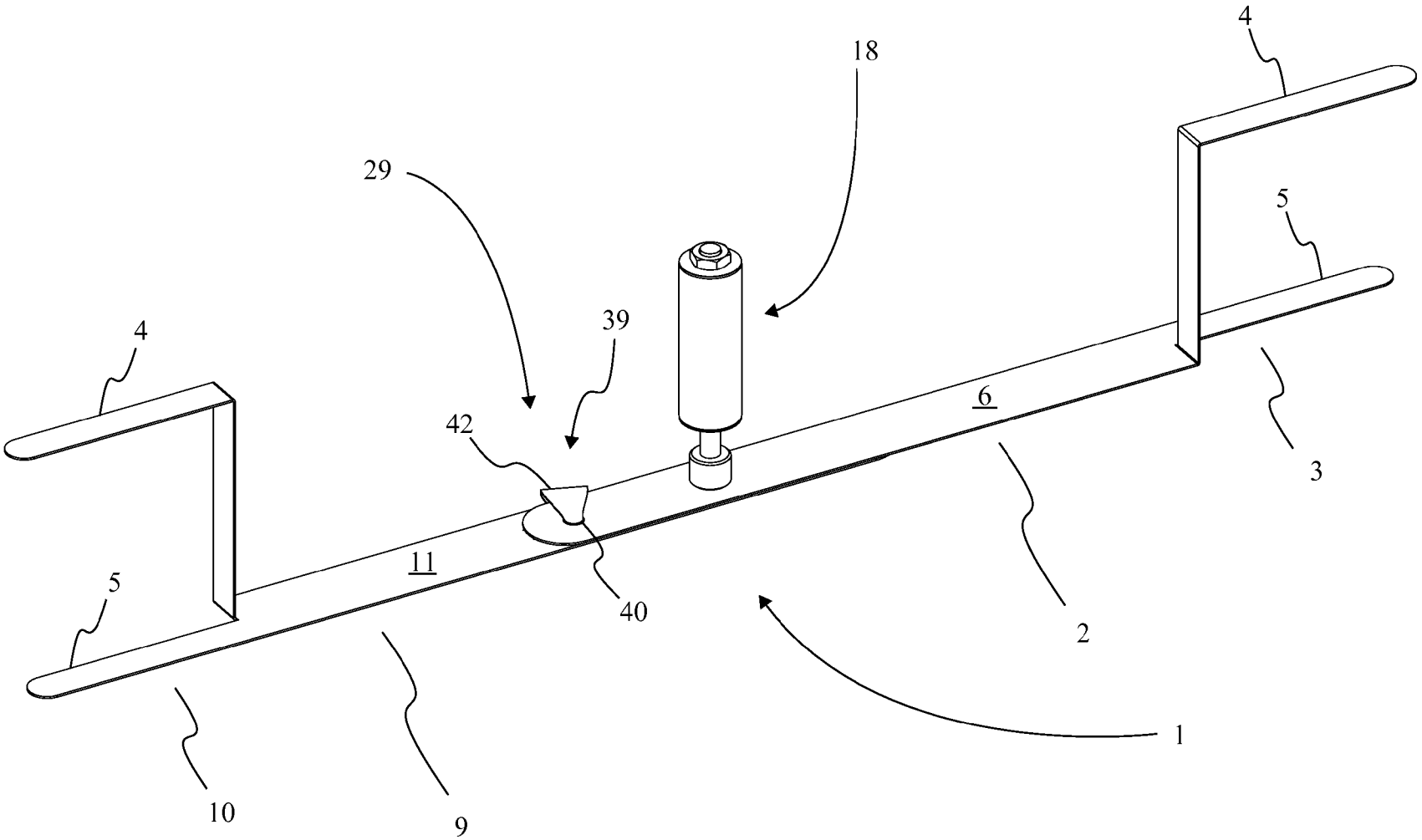
FIG. 12 is a perspective view displaying the collapsible cord holder, utilizing the retainer clip as the locking mechanism, in the extended configuration as per the additional embodiment of the present invention.
Figure 13:
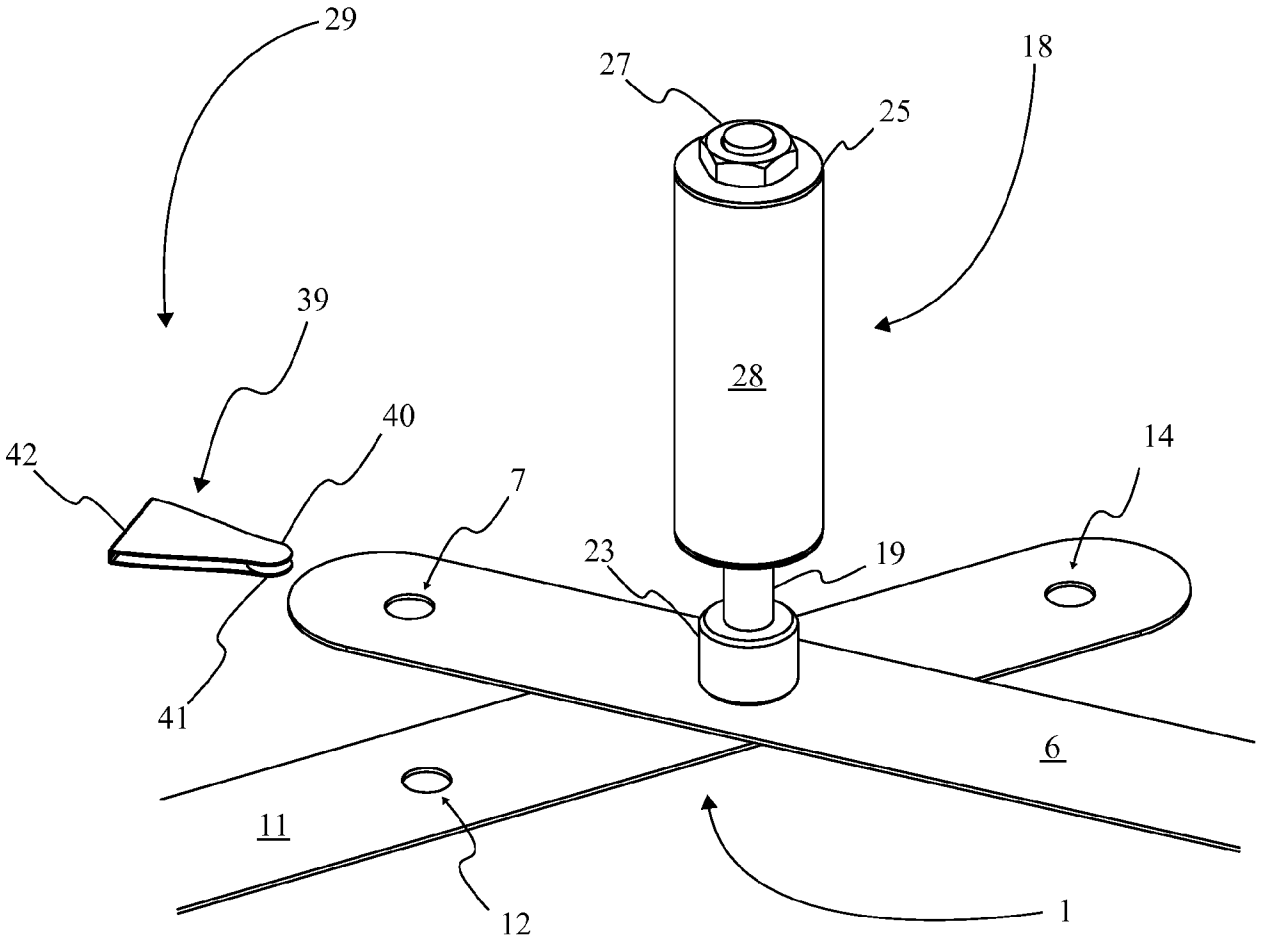
FIG. 13 is an enhanced perspective view displaying the collapsible cord holder, utilizing the retainer clip as the locking mechanism as per the additional embodiment of the present invention.

Referencing FIG. 10-12, in the aforementioned additional embodiment, where the locking mechanism 29 comprises the retainer clip 39, the user would position the collapsible cord holder within the circular opening of a cord bundle. The user would engage the first retainer mount 3 and the second retainer mount 10 with the cord bundle. After which the user would proceed to disengage the second rounded clasp 41 from the second closed lock mount 14. The user would pull the second rounded clasp 41 away from the second closed lock mount 14 bending the flexible member 42. The user would then pivot the second arm 9 about the handle assembly mount 16. Upon pivoting the second arm 9, the first retainer mount 3 and the second retainer mount 10 would traverse along the interior of the cord bundle tightening and providing shape until the first lock mount 7 became coincident with the second open lock mount 12. At which point the user would allow the elasticity of the flexible member 42 to return the second rounded clasp 41 to its new resting position within the second open lock mount 12. The user would be able to unwind the cord bundle by grasping the handle assembly 18, wherein the handle assembly 18 would permit rotation of the extendable arm assembly 1 as needed.

In another additional embodiment of the present invention, the locking mechanism 29 magnetically retains the first longitudinal body 6 against the second longitudinal body 11. The locking mechanism 29 comprises a first magnetic coupler and a second magnetic coupler. The first magnetic coupler would be positioned within the first longitudinal body 6. The second magnetic coupler would be positioned within the second longitudinal body 11. The positioning of the first magnetic coupler within the first longitudinal body 6 and the positioning of the second magnetic coupler within the second longitudinal body 11 would allow for a detachable engagement that would exist whenever the first longitudinal body 6 was coincident with the second longitudinal body 11. Through the inherent geometric properties the first longitudinal body 6 and the second longitudinal body 11 would have the strongest magnetic attraction when aligned.

In the aforementioned additional embodiment, where the locking mechanism 29 comprises the first magnetic coupler and the second magnetic coupler, the user would position the collapsible cord holder within the circular opening of a cord bundle. The user the first retainer mount 3 and the second retainer mount 10 with the cord bundle. After which, the user would proceed to disengage the first magnetic coupler from the second magnetic coupler. The user would pivot the first arm 2 about the handle assembly mount 16 disrupting the coincident alignment between the first longitudinal body 6 and the second longitudinal body 11. Upon pivoting the second arm 9, the first retainer mount 3 and the second retainer mount 10 would traverse along the interior of the cord bundle tightening and providing shape until the first magnetic coupler became coincident with the second magnetic coupler. At which point the first longitudinal body 6 would become aligned with the second longitudinal body 11. The user would be able to unwind the cord bundle by grasping the handle assembly 18, wherein the handle assembly 18 would permit rotation of the extendable arm assembly 1 as needed.

Figure 14:
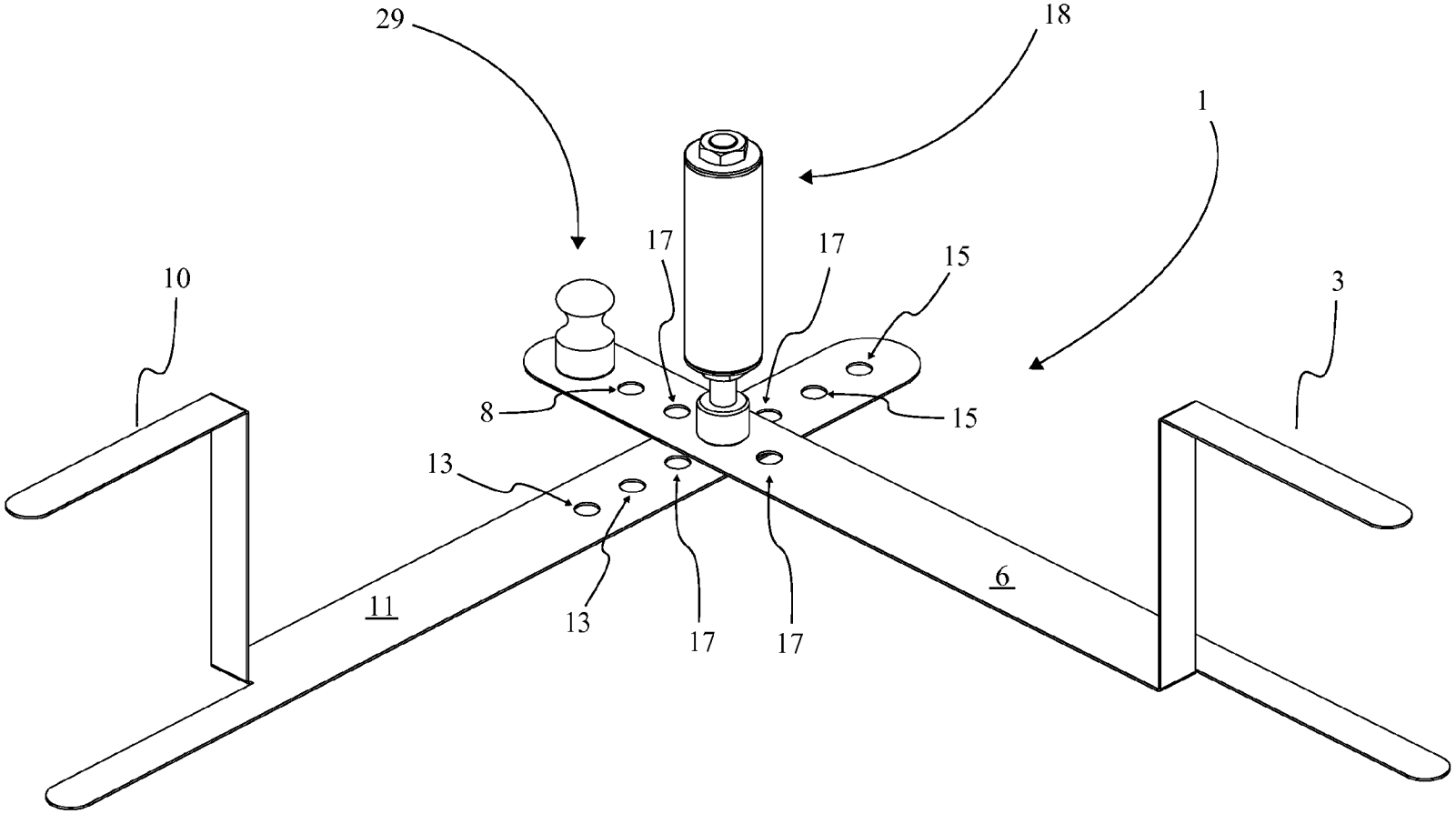
FIG. 14 is an enhanced perspective view displaying the collapsible cord holder, utilizing a plurality of handle assembly mounts, a plurality of first lock mounts, a plurality of second open lock mounts, and a plurality of second closed lock mounts, as per the additional embodiment of the present invention.

Referencing FIG. 14, in an additional embodiment of the present invention, the distance between the first retainer mount 3 and the second retainer mount 10 in the extended configuration is provided as variable, permitting the extendable arm assembly 1 to engage differently sized cord bundles. In order to accomplish this, the extendable arm assembly 1 comprises a plurality of handle assembly mounts 17. The plurality of handle assembly mounts 17 provide the extendable arm assembly 1 with a means of adjusting the distance between the first retainer mount 3 and the second retainer mount 10 while permitting a centrally positioned engagement point with the handle assembly 18. In order to secure the extendable arm assembly 1, in the additional embodiment, the first longitudinal body 6 comprises a plurality of first lock mounts 8, while the second longitudinal body 11 comprises a plurality of second open lock mounts 13 and a plurality of second closed lock mounts 15. The plurality of first lock mounts 8 are provided as complementary components to the plurality of second open lock mounts 13 and the plurality of second closed lock mounts 15 whose engagement is dependent on the configuration state of the extendable arm assembly 1.

In an additional embodiment of the present invention, the handle assembly 18 would additionally function as the locking mechanism 29. The additional embodiment would provide a dedicated pivot point that would couple the first arm 2 and the second arm 9. The handle assembly 18 would include a detachable locking mechanism 29 that would secure the first arm 2 and the second arm 9 for the extended configuration and the collapsed configuration. The handle assembly 18 would continue to function as the centrally positioned axle shaft. In order to enable the aforementioned configuration the first retainer mount 3 and the second retainer mount 10 would be found positioned adjacent along the first longitudinal body 6 and the second longitudinal body 11. This arrangement is due to the dedicated pivot point being offset from the mid-point of the apparatus.

In an additional embodiment of the present invention, the first retainer mount 3 and the second retainer mount 10 would be constructed of a flexible material that would enable the elongated member 5 and the angled member 4 to grasp cord bundles of different widths. In the aforementioned additional embodiment the first retainer mount 3 and the second retainer mount 10 would be provided with additional structural support to compensate for the flexible construction. The additional structural support would likely be provided at the engagement between the first retainer mount 3 and the first longitudinal body 6, and the second retainer mount 10 and the second longitudinal body 11.

Although the invention has been explained in relation to its preferred embodiment, it is to be understood that many other possible modifications and variations can be made without departing from the spirit and scope of the invention as hereinafter claimed.

What is claimed is:

1. A collapsible cord holder for unwinding cord bundles comprises:

an extendable arm assembly;

a handle assembly;

a locking mechanism;

the extendable arm assembly comprises a first arm, a second arm, and a handle assembly mount;

the handle assembly comprises a rod, a key ring fastener, a bearing plate, a bottom spacer, a first disc bearing, a second disc bearing, a first disc fastener, a second disc fastener, and a shaft handle;

the first arm comprises a first retainer mount and a first longitudinal body;

the second arm comprises a second retainer mount and a second longitudinal body;

the rod comprises a first rod end and a second rod end;

both the first retainer mount and the second retainer mount each comprise an angled member and an elongated member;

the first longitudinal body comprises a first lock mount;

the second longitudinal body comprises a second open lock mount and a second closed lock mount;

the extendable arm assembly being centrally engaged to the handle assembly by way of the handle assembly mount;

the extendable arm assembly being rotatably coupled to the handle assembly;

the extendable arm assembly capable of being secured by way of the locking mechanism; and the locking mechanism being positioned adjacent to the handle assembly;

the first arm and the second arm being rotatably coupled about the handle assembly mount;

the handle assembly traverses through the first arm and the second arm by way of the handle assembly mount;

the handle assembly mount being positioned between the first lock mount and the first retainer mount;

the handle assembly mount being positioned between the second open lock mount and the second closed lock mount;

the first retainer mount being terminally coupled to the first longitudinal body opposite the first lock mount;

the second retainer mount being terminally coupled to the second longitudinal body opposite the second closed lock mount;

the first retainer mount and the second retainer mount being positioned equidistantly to the handle assembly mount;

both the second open lock mount and the second closed lock mount being rotatably coincident with the first lock mount;

the elongated member of the first retainer mount being engaged collinearly with the first longitudinal body;

the elongated member of the second retainer mount being engaged collinearly with the second longitudinal body;

the angled member of the first retainer mount being positioned perpendicularly to the first longitudinal body; and the angled member of the second retainer mount being positioned perpendicularly to the second longitudinal body.

2. The collapsible cord holder for unwinding cord bundles as claimed in claim 1, wherein the angled member being engaged adjacent to the elongated member, where the perpendicular positioning of the angled member to the elongated member is non coplanar.

3. The collapsible cord holder for unwinding cord bundles as claimed in claim 1 comprises:

the extendable arm assembly comprises a plurality of handle assembly mounts;

the first longitudinal body comprises a plurality of first lock mounts;

the second longitudinal body comprises a plurality of second open lock mounts and a plurality of second closed lock mounts;

the handle assembly being coincident with the plurality of handle assembly mounts;

the plurality of second open lock mounts and the plurality of second closed lock mounts being coincident with the plurality of first lock mounts.

4. The collapsible cord holder for unwinding cord bundles as claimed in claim 1 comprise:

the extendable arm assembly being rotatable about the rod;

the handle assembly being secured to the extendable arm assembly by way of the key ring fastener;

the handle assembly mount being traversed by the rod first end;

the extendable arm assembly being positioned between the key ring fastener and the bottom spacer;

the first arm being rotatably coincident with the bottom spacer;

the second arm being rotatably coincident with the key ring fastener;

the bearing plate being positioned between the first arm and the second arm;

both the first longitudinal body and the second longitudinal body being rotatably engaged with the bearing plate;

the shaft handle being rotatable about the second rod end;

the shaft handle being rotatably engaged between the first disc bearing and the second disc bearing;

the first disc bearing being retained against the shaft handle by way of the first disc fastener;

the second disc bearing being retained against the shaft handle by way of the second disc fastener.

5. The collapsible cord holder for unwinding cord bundles as claimed in claim 1 comprises:

the locking mechanism comprises a compression plunger assembly;

the compression plunger assembly comprises a plunger assembly and a base mount;

the plunger assembly comprises a plunger handle, an assembly shroud, a piston, and a spring;

the base mount comprises a piston shaft;

the base mount being securely mounted to the first longitudinal body;

the piston shaft being centrally aligned with the first lock mount;

the plunger assembly being elastically retained to the base mount by way of the spring;

the piston, the spring, and the assembly shroud being concentrically positioned on the plunger handle;

the piston shaft is found positioned between the spring and the piston;

the spring being positioned between the piston shaft and the assembly shroud;

the piston traverses through the piston shaft and the first lock mount; and the piston being elastically engaged with the second longitudinal body.

6. The collapsible cord holder for unwinding cord bundles as claimed in claim 1 comprises:

the locking mechanism comprises a retainer clip;

the retainer clip comprises a first rounded clasp, a second rounded clasp, and a flexible member;

the retainer clip being rotatably coupled to the extendable arm assembly;

the first rounded clasp being elastically retained against the second rounded clasp by way of the flexible member;

the first rounded clasp being coincident with the first lock mount; and both the second open lock mount and the second closed lock mount being coincident with the second rounded clasp.

* * * * *